US006339382B1

(12) United States Patent
Arbinger et al.

(10) Patent No.: US 6,339,382 B1
(45) Date of Patent: Jan. 15, 2002

(54) EMERGENCY VEHICLE ALERT SYSTEM

(76) Inventors: Donald A. Arbinger, 913 Irish Rd., #12, Neenah, WI (US) 54856; Dennis R. Bergin, W6827 Alder Way, Appleton, WI (US) 54915; Shane M. Pieper, 13950 W. Prospect, New Berlin, WI (US) 53151; Scott T. Sander, 6187 W. Coldspring Rd., Greenfield, WI (US) 53220

( * ) Notice: Subject to any disclaimer, the term of this patent is extended or adjusted under 35 U.S.C. 154(b) by 0 days.

(21) Appl. No.: 09/731,595

(22) Filed: Dec. 7, 2000

Related U.S. Application Data

(60) Provisional application No. 60/169,562, filed on Dec. 8, 1999.

(51) Int. Cl.[7] ..... G08G 1/16
(52) U.S. Cl. ..... 340/903; 340/902; 701/301
(58) Field of Search ..... 340/901, 902, 340/903; 701/301

(56) References Cited

U.S. PATENT DOCUMENTS 5,317,321 A * 5/1994 Sass ..... 342/176
5,636,123 A 6/1997 Rich et al. ..... 364/461
5,872,526 A 2/1999 Tognazzinni ..... 340/961
5,890,682 A * 4/1999 Welk ..... 340/902
5,983,161 A * 11/1999 Lemelson et al. ..... 340/903
6,002,345 A * 12/1999 Ohmura et al. ..... 340/903
6,038,502 A * 3/2000 Sudo ..... 701/301
6,087,961 A * 7/2000 Markow ..... 340/902
6,160,493 A * 12/2000 Smith ..... 340/902

* cited by examiner

*Primary Examiner*—Daniel J. Wu
(74) *Attorney, Agent, or Firm*—Donald J. Ersler

(57) ABSTRACT

An emergency vehicle alert system includes an emergency vehicle unit, a motor vehicle unit and a plurality of global positioning system (GPS) signals. The emergency vehicle unit includes an emergency GPS receiver, and RF transmitter. The motor vehicle unit includes a vehicle GPS receiver, RF receiver, microcontroller, and warning display. The emergency GPS receiver inputs at least three GPS signals from a plurality of GPS satellites. The emergency GPS receiver transforms the at least three GPS signals into an emergency location signal string. The emergency location signal string is transmitted by the RF transmitter. Each RF receiver which is within range of the emergency vehicle transmission will receive the emergency location signal string. The vehicle GPS receiver inputs at least three different GPS signals from the plurality of GPS satellites. The vehicle GPS receiver transforms the at least three different GPS signals into a vehicle location signal string. The microcontroller compares the location of the emergency vehicle to the location of the motor vehicle and enables at least one indicator lamp.

8 Claims, 8 Drawing Sheets

EMERGENCY VEHICLE ALERT SYSTEM

CROSS-REFERENCES TO RELATED APPLICATIONS

This is a utility application taking priority from provisional application, serial number 60/169,562 filed on Dec. 8, 1999.

BACKGROUND OF THE INVENTION

1. Field of the Invention

The present invention relates generally to emergency vehicles and more specifically to an emergency vehicle alert system which informs the driver of a motor vehicle that an emergency vehicle is close and its location relative to the motor vehicle.

2. Discussion of the Prior Art

The major challenge for emergency vehicles is traveling through traffic as quickly and safely as possible to get to its destination. At this point in time, the only way for an emergency vehicle to alert vehicles in its path is through an audible siren and emergency lights. Many times, an emergency vehicle coming from behind a motor vehicle cannot be seen or heard until the emergency vehicle is right on top of the motor vehicle. It takes time for the driver to react and maneuver to a location which does not obstruct the emergency vehicle. A more dangerous situation is an emergency vehicle crossing an intersection. It is very difficult for the drivers of oncoming traffic to see or hear an emergency vehicle "buried" in an intersection. The inability of sirens and emergency lights to fully warn motorists of an emergency vehicle's presence results in thousands of accidents each year.

There have been some proposed solutions to the limitations of sirens and emergency lights. A first solution is the use of optical detectors at an intersection that detect light signals emitted from an approaching emergency vehicle. The optical detector would manipulate the traffic signal for oncoming traffic. The drawback to this device is the lack of warning when the emergency vehicle is coming from behind a motor vehicle.

A second solution is the use of a radar detector. Radar detectors would be used to detect a signal transmitted from an emergency vehicle. One drawback is that false triggering may result in motorist turning off the radar detector out of frustration. Further, the location and distance of the emergency vehicle relative to the motor vehicle would not be available.

A third solution is transmission of an RF signal from an emergency vehicle. Each motor vehicle would have an RF receiver which would receive the RF signal. The distance of the emergency vehicle from the motor vehicle would be displayed on a plurality of lights. Each light would have a value of a particular distance from the emergency vehicle. However, the location of the emergency vehicle relative to the motor vehicle would not be available.

Accordingly, there is a clearly felt need in the art for an emergency vehicle alert system which warns the driver of a motor vehicle that an emergency vehicle is close and its location relative to the motor vehicle.

SUMMARY OF THE INVENTION

The primary objective of the present invention is to provide an emergency vehicle alert system which warns the driver of a motor vehicle that an emergency vehicle is close and its location relative to the motor vehicle.

According to the present invention, an emergency vehicle alert system includes an emergency vehicle unit, a motor vehicle unit and at least three global positioning system (GPS) signals. The emergency vehicle unit includes an emergency GPS antenna, emergency GPS receiver, RF transmitter, emergency RF antenna, and emergency power source. The motor vehicle unit includes a vehicle GPS antenna, vehicle GPS receiver, vehicle RF antenna, RF receiver, microcontroller, warning display, and vehicle power source.

The at least three GPS signals are continuously broadcast from a plurality of GPS satellites. The emergency GPS antenna receives signals from the plurality of GPS satellites. The at least three GPS signals are input into the emergency GPS receiver. The emergency GPS receiver triangulates the at least three GPS signals into an emergency location signal string which is described by a particular longitude and latitude. The longitude and latitude information is inputed into the emergency RF transmitter and broadcast through the emergency RF antenna.

Each vehicle RF antenna which is within range of the emergency vehicle transmission will receive the emergency vehicle longitude and latitude information. The RF receiver inputs the information and sends the emergency vehicle longitude and latitude information to the microcontroller. The vehicle GPS antenna receives at least three different GPS signals from the plurality of GPS satellites. The at least three different GPS signals are input into the vehicle GPS receiver. The vehicle GPS receiver outputs a vehicle location signal string having longitude, latitude, and heading into the microcontroller. The microcontroller compares the location of the emergency vehicle to the location of the motor vehicle. Preferably, the microcontroller will enable at least one of four indicator lamps which indicate the location of the emergency vehicle relative to the motor vehicle.

Accordingly, it is an object of the present invention to provide an emergency vehicle alert system which informs a motor vehicle driver of the location of an emergency vehicle relative to their motor vehicle.

It is a further object of the present invention to provide an emergency vehicle alert system which does not require installations at street intersections.

Finally, it is another object of the present invention to provide an emergency vehicle alert system which informs a driver when an emergency vehicle is close to their motor vehicle.

These and additional objects, advantages, features and benefits of the present invention will become apparent from the following specification.

DETAILED DESCRIPTION OF THE PREFERRED EMBODIMENTS

Figure 1:
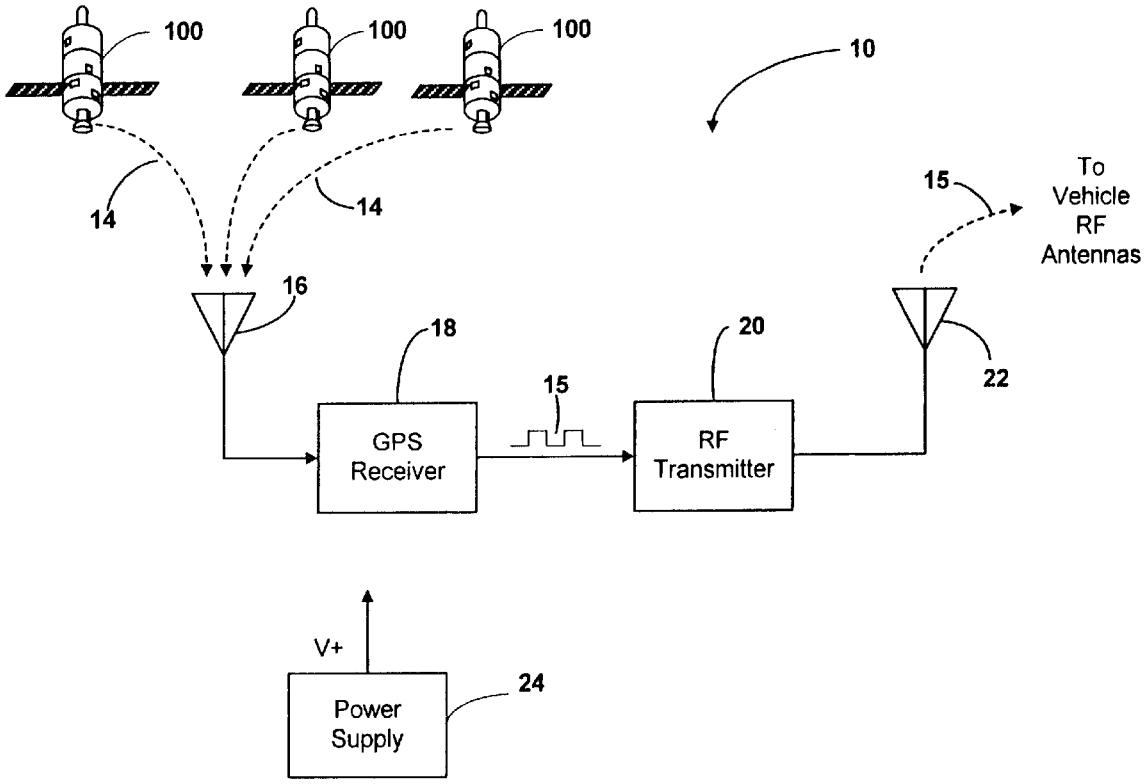
FIG. 1 is a block diagram of the emergency vehicle unit in accordance with the present invention.

With reference now to the drawings, and particularly to FIG. 1, there is shown a block diagram of the emergency vehicle unit 10 of the emergency vehicle alert system. An emergency vehicle alert system includes an emergency vehicle unit 10, a motor vehicle unit 12 and a plurality of global positioning system (GPS) signals 14. The emergency vehicle unit 10 includes an emergency GPS antenna 16, emergency GPS receiver 18, RF transmitter 20, emergency RF antenna 22, and emergency power source 24. The motor vehicle unit 12 includes a vehicle GPS antenna 28, vehicle GPS receiver 30, vehicle RF antenna 32, RF receiver 34, microcontroller 36, warning display 38, and vehicle power source 40. The emergency power source 24 supplies electrical power to the electronic components in the emergency vehicle unit 10. The vehicle power source 40 supplies electrical power to the electronic components in the motor vehicle unit 12.

The plurality of GPS signals 14 are continuously broadcast from the plurality of GPS satellites 100. The emergency GPS antenna 16 receives at least three GPS signals 14 from the plurality of GPS satellites 100. The at least three GPS signals 14 are input into the emergency GPS receiver 18. The emergency GPS receiver 18 triangulates the plurality of GPS signals 14 into an emergency location signal string 15 which is described by a particular longitude and latitude. The emergency location signal string 15 is inputed into the RF transmitter 20 and then transmitted through the emergency RF antenna 22. A Motorola GT Plus Oncore is preferably utilized for the emergency GPS receiver 18 and a Motorola Oncore Active GPS Antenna is preferably utilized for the emergency GPS antenna 16. Any RF transmitter capable of receiving digital data and transforming thereof into an analog equivalent for RF transmission may be used for the RF transmitter 20.

Each motor vehicle unit 12 which is within range of the emergency vehicle transmission will receive the emergency location signal string 15 through the vehicle RF Antenna 32. The RF receiver 34 must be able to take the analog signal from the vehicle RF antenna 32 and transform thereof back into the original digital data. The RF receiver 34 inputs the emergency location signal string 15 and sends thereof to the microcontroller 36. The vehicle GPS antenna 28 receives at least three different GPS signals 14 from the plurality of GPS satellites 100. The at least three different GPS signals 14 are input by the vehicle GPS receiver 30. The vehicle GPS receiver 30 outputs a motor vehicle location signal string 42 to the microcontroller 36. The microcontroller 36 stores all the signal strings in the memory 26.

Figure 3:
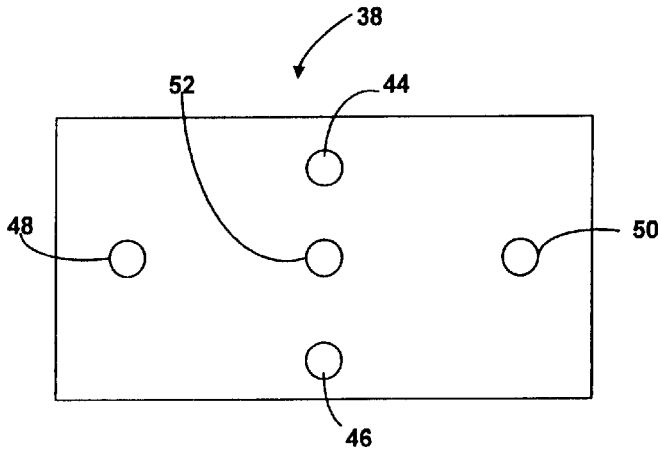
FIG. 3 is a front view of the warning display in accordance with the present invention.
Figure 2:
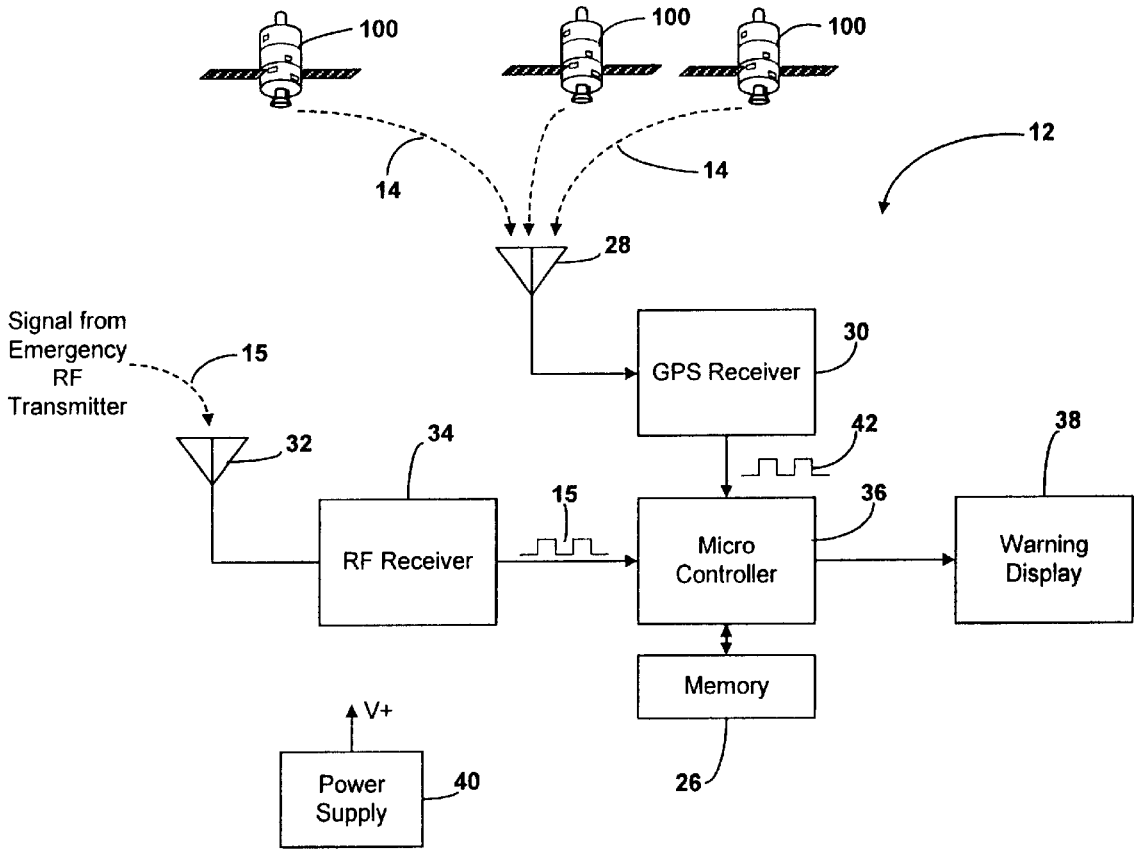
FIG. 2 is a block diagram of the motor vehicle unit in accordance with the present invention.
Figure 4:
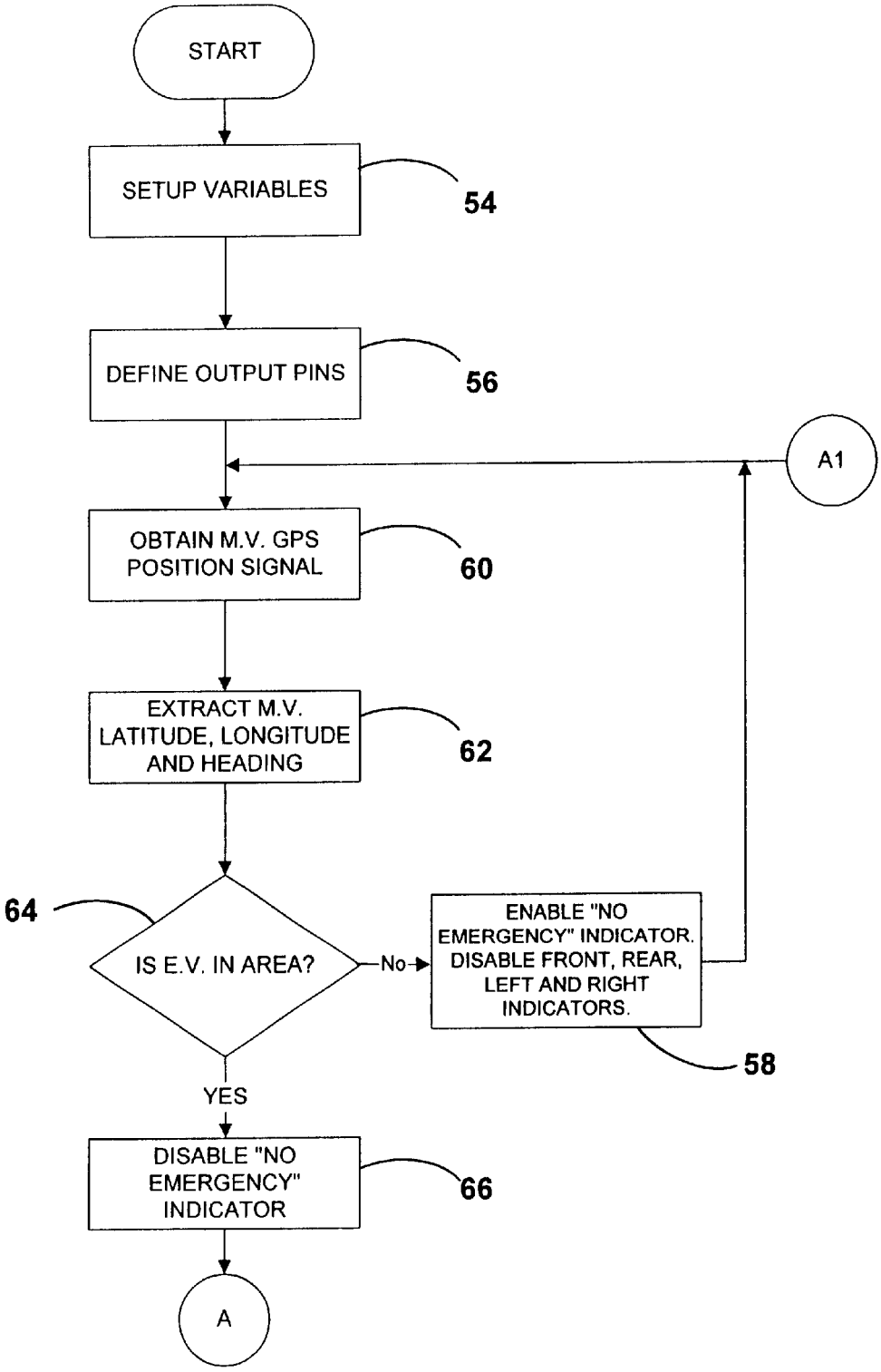
FIG. 4 is a first page of a flow chart of the software contained within the microcontroller for determining the position of a motor vehicle relative to an emergency vehicle in accordance with the present invention.
Figure 5:
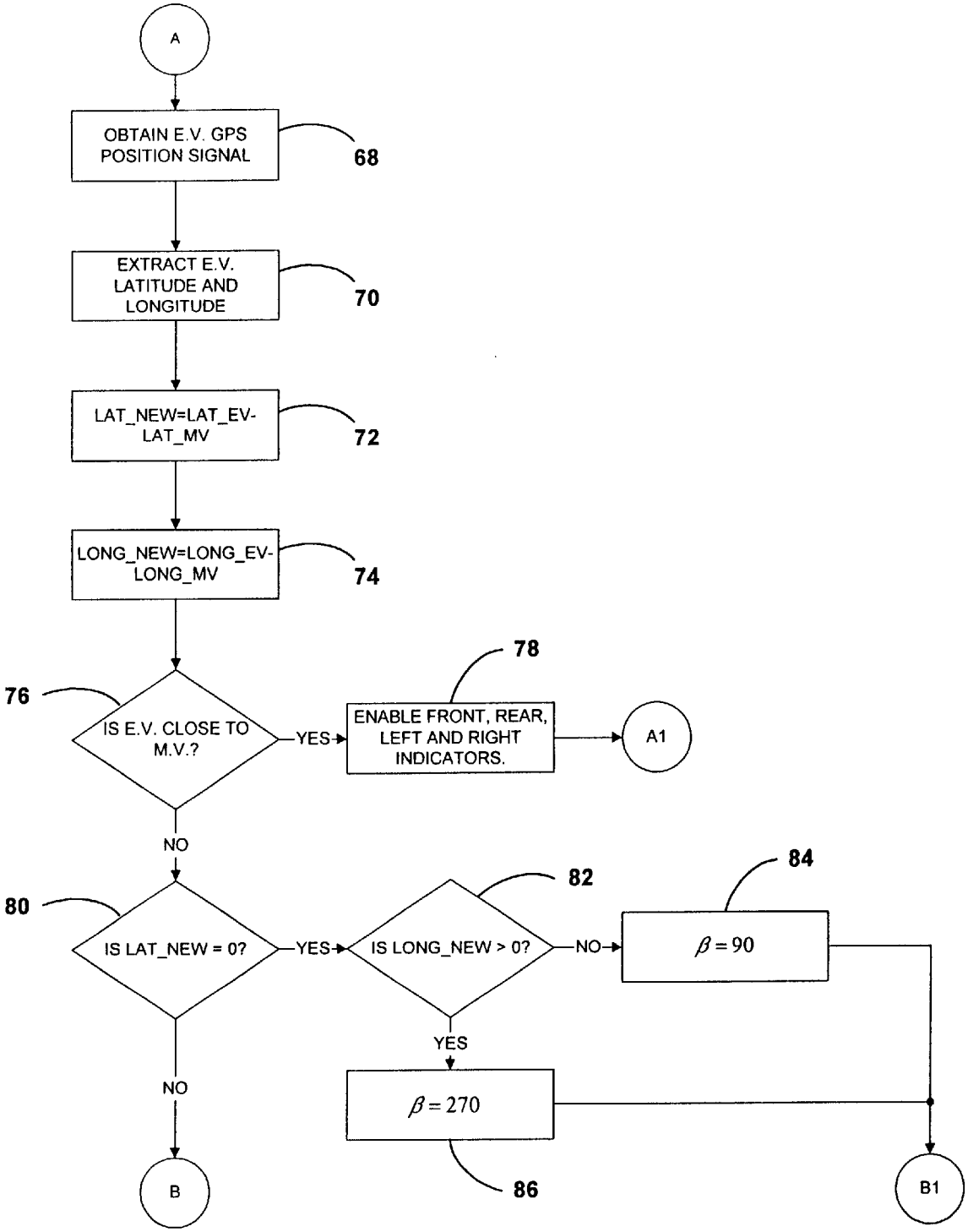
FIG. 5 is a second page of a flow chart of the software contained within the microcontroller for determining the position of a motor vehicle relative to an emergency vehicle in accordance with the present invention.
Figure 6:
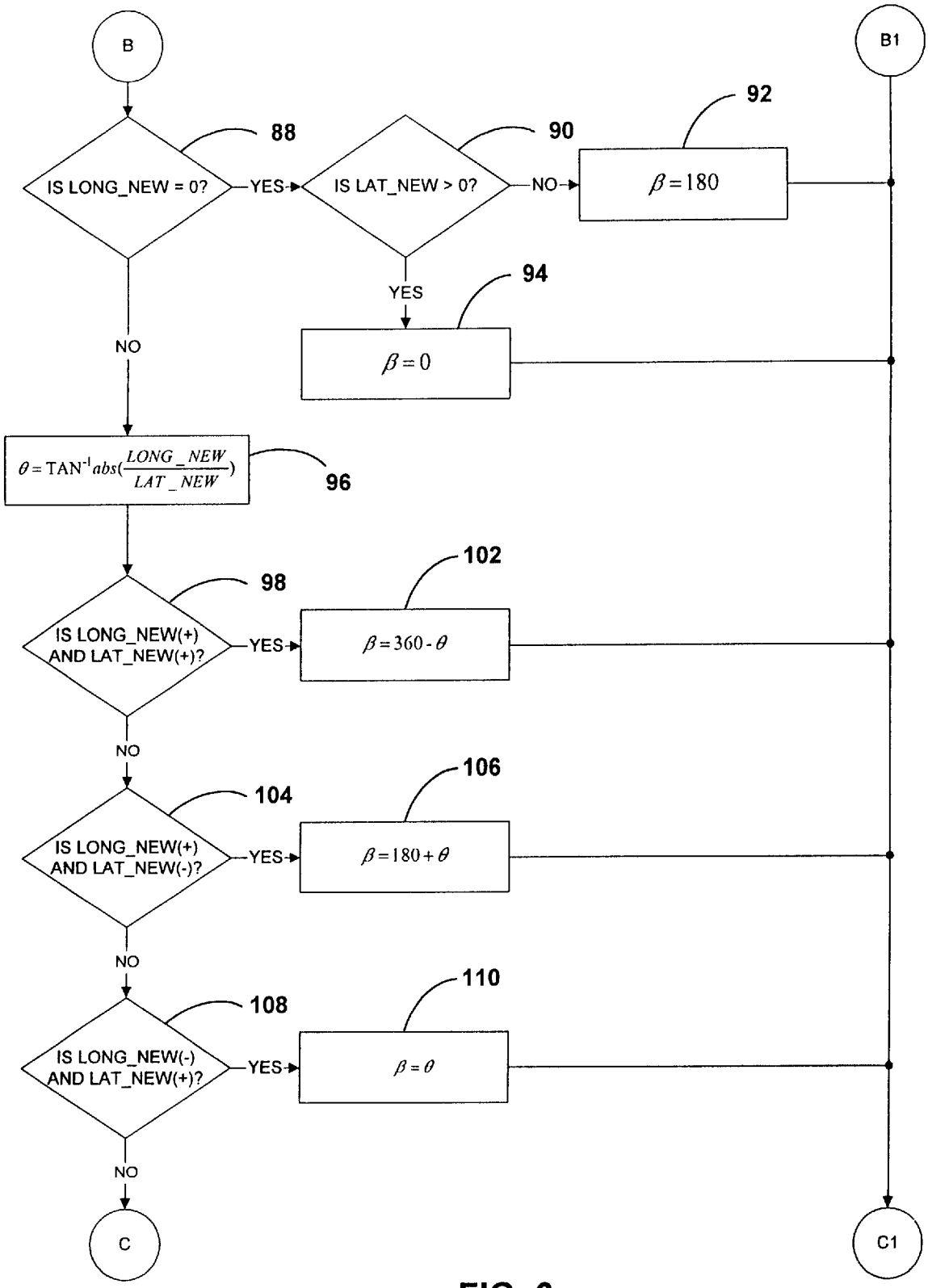
FIG. 6 is a third page of a flow chart of the software contained within the microcontroller for determining the position of a motor vehicle relative to an emergency vehicle in accordance with the present invention.
Figure 7:
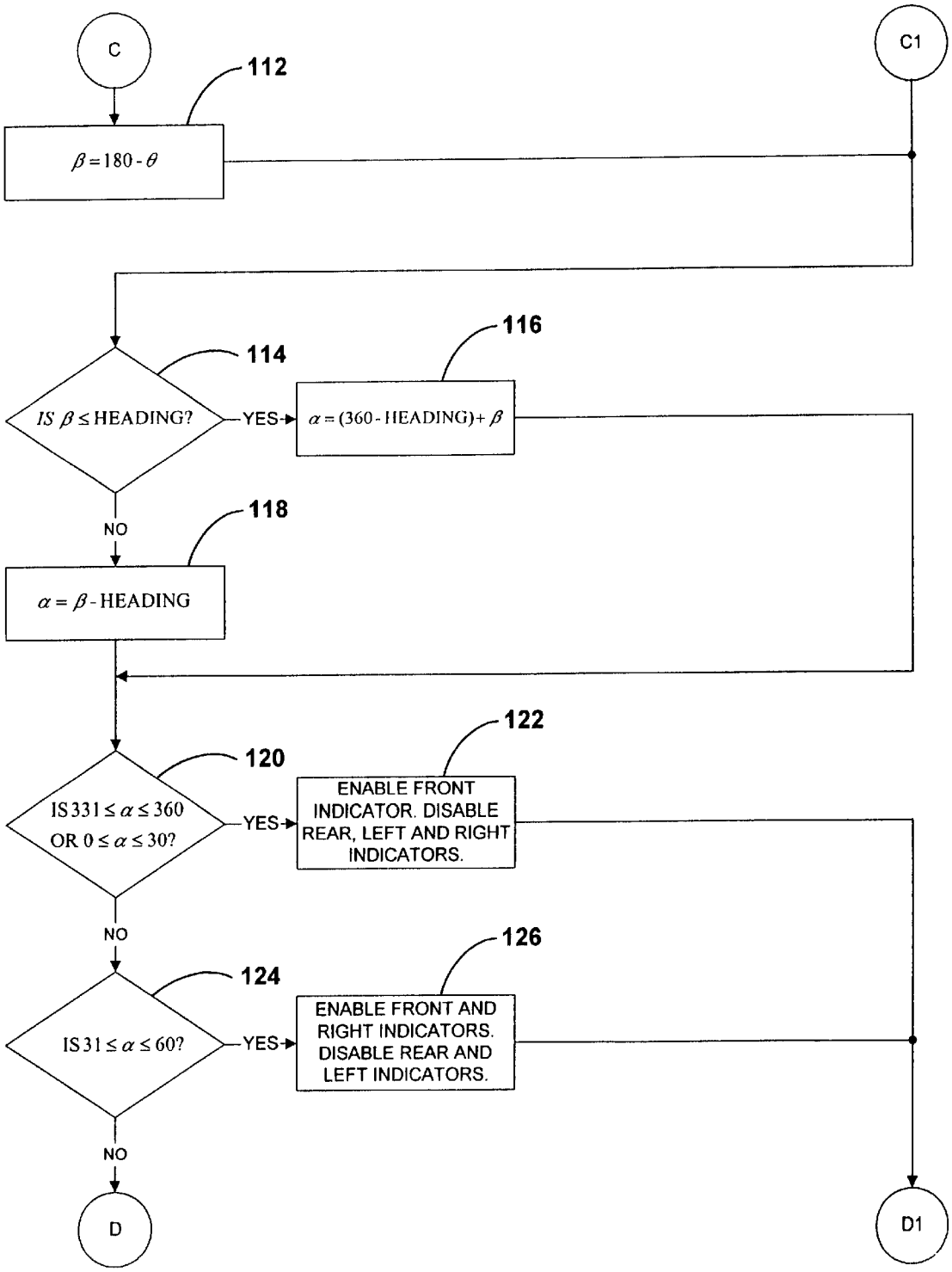
FIG. 7 is a fourth page of a flow chart of the software contained within the microcontroller for determining the position of a motor vehicle relative to an emergency vehicle in accordance with the present invention.
Figure 8:
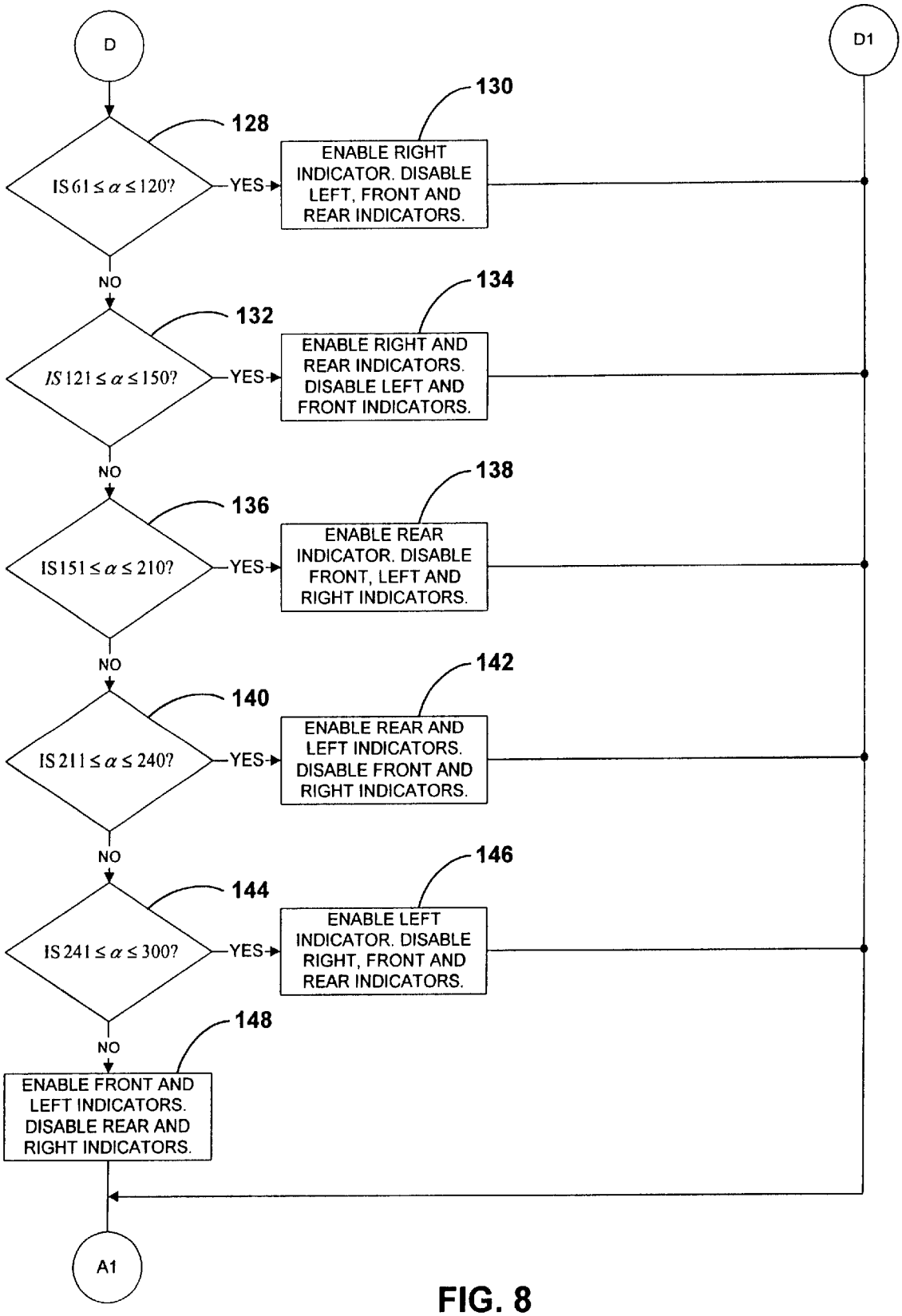
FIG. 8 is a fifth page of a flow chart of the software contained within the microcontroller for determining the position of a motor vehicle relative to an emergency vehicle in accordance with the present invention.

FIG. 3 discloses a front view of the warning display 38 of the motor vehicle unit 12 which alerts a driver that an emergency vehicle is close. The warning display 38 preferably includes a front indicator lamp 44, a rear indicator lamp 46, a left indicator lamp 48, a right indicator lamp 50, and a no emergency vehicle indicator lamp 52. The indicator lamps may be LEDs or any other suitable light emitting device.

FIGS. 4–8 disclose a flow chart of the software contained within the microcontroller for determining the position of a motor vehicle relative to an emergency vehicle. Both the emergency vehicle and motor vehicle location signals are defined by a string of data. The string of data may comprise header data or the start of the position string, position data, heading data, velocity data, and checksum data. The checksum data can be used to determine if the motor vehicle signal string was received correctly. Please note the abbreviations: M.V.=motor vehicle and E.V.=emergency vehicle in FIGS. 4–8.

Variables are defined in process block 54 which store the required parameters. Output pins of the microcontroller 36 are defined in process block 56. The output pins enable the four direction indicator lamps and the no emergency vehicle indicator lamp 52. The position of a motor vehicle is obtained by the microcontroller capturing the motor vehicle location signal string 42 in process block 60. The latitude, longitude and heading data will be extracted from the motor vehicle signal location string 42 in process block 62. The microcontroller checks for the presence of an emergency location signal string 15 in decision block 64. If an emergency location signal string 15 is captured, the no emergency indicator lamp 52 is disabled in process block 66 and the program continues to determine the proximity of the emergency vehicle relative to the motor vehicle. If no emergency vehicle is present; the no emergency vehicle indicator lamp 52 is enabled in process block 58; the front, rear, left, and right indicator lamps are disabled; and the program loops back to process block 60.

The emergency vehicle location signal string 15 is captured in process block 68. The latitude and longitude data will be extracted from the emergency vehicle location signal string 15 in process block 70. The latitude of the motor vehicle is subtracted from the latitude of the emergency vehicle in process block 72 to produce Lat_new. The longitude of the motor vehicle is subtracted from the longitude of the emergency vehicle in process block 74 to produce Long_new. The distance between the motor vehicle and the emergency vehicle is reviewed to see if they are too close in decision block 76. Preferably, if the distance is less than 200 feet, the emergency vehicle is considered too close. Other values of distance may also be used.

If the distance is too close, the right, left, rear, and front indicator lamps are enabled in process block 78. The program returns to check if the emergency vehicle is still too close to the motor vehicle. If the distance is not too close, the value of Lat_new is reviewed to see if it is equal to zero in decision block 80. If Lat_new is equal to zero, then Long_new is reviewed to see if it is greater than zero in decision block 82. If Long_new is greater than zero, then define $\beta=270$ in process block 86. If Long_new is not greater than zero, then define $\beta=90$ in process block 84.

If Lat_new is not equal to zero then Long_new is reviewed to see if it is equal to zero in decision block 88. If Long_new is equal to zero, then Lat_new is reviewed to see if it is greater than zero in decision block 90. If Lat_new is not greater than zero, then define $\beta=180$ in process block 92. If Lat_new is greater than zero, then define $\beta=0$ in process block 94. If Long_new is not equal to zero, then define the following formula in process block 96: $\theta=TAN^{-1}$ abs(Long_new/Lat_new). The letters "abs" indicates the absolute value.

Figure 9:
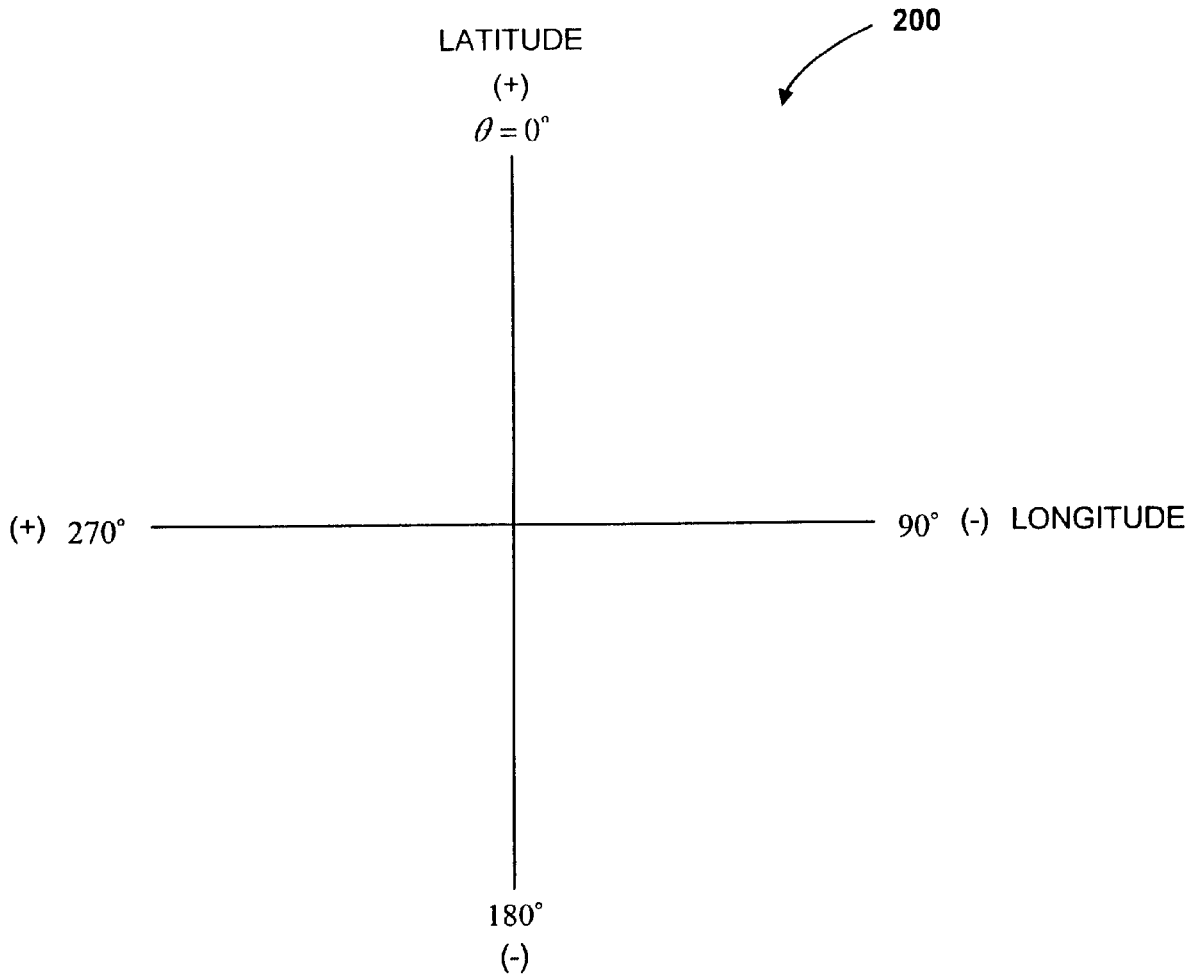
FIG. 9 is a coordinate system for determining the position of a motor vehicle relative to an emergency vehicle in accordance with the present invention.

FIG. 9 shows a coordinate system 200. The variables Lat_new and Long_new are reviewed to define an angle $\beta$ in the coordinate system 200 in decision block 98. Longitude has a horizontal axis and Latitude has a vertical axis. If Lat_new is positive and Long_new is positive then define $\beta=360-\theta$ e in process block 102. If Lat_new is not positive and Long_new is not positive then review in decision block 104. If Lat_new is negative and Long_new is positive then define $\beta=180+\theta$ in process block 106. If Lat_new is not negative and Long_new is not positive then review in decision block 108. If Lat_new is positive and Long_new is negative then define $\beta=\theta$ in process block 110. If Lat_new is not positive and Long_new is not negative, define $\beta=180-\theta$ in process block 112.

In decision block 114, the angle of $\beta$ is reviewed to see if it's less than or equal to heading. If $\beta$ is less than or equal to the heading, then define $\alpha=(360-\text{heading})+\beta$ in process block 116. If $\beta$ is not less than or equal to the heading, then define $\alpha=\beta-\text{heading}$ in process block 118. In decision block 120, the angle $\alpha$ is reviewed to see if it less than or equal to 360 degrees and greater than or equal to 331 degrees, or if it less than or equal to 30 degrees and greater than or equal to zero degrees; if so, enable the front indicator lamp 44, disable the rear, left and right indicator lamps in process block 122; if not, continue. In decision block 124, the angle $\alpha$ is reviewed to see if it less than or equal to 60 degrees and greater than or equal to 31 degrees; if so, enable the front and right indicator lamps, disable the rear and left indicator lamps in process block 126; if not, continue.

In decision block 128, the angle $\alpha$ is reviewed to see if it less than or equal to 120 degrees and greater than or equal to 61 degrees; if so, enable the right indicator lamp 50, disable the left, front and rear indicator lamps in process block 130; if not, continue. In decision block 132, the angle $\alpha$ is reviewed to see if it less than or equal to 150 degrees and greater than or equal to 121 degrees; if so, enable the right and rear indicator lamps, disable the left and front indicator lamps in process block 134; if not, continue. In decision block 136, the angle $\alpha$ is reviewed to see if it less than or equal to 210 degrees and greater than or equal to 151 degrees; if so, enable the rear indicator lamp 46, disable the front, left, and right indicator lamps in process block 138; if not, continue.

In decision block 140, the angle $\alpha$ is reviewed to see if it less than or equal to 240 degrees and greater than or equal to 211 degrees; if so, enable the rear and left indicator lamps, disable the front and right indicator lamps in process block 142; if not, continue. In decision block 144, the angle $\alpha$ is reviewed to see if it less than or equal to 300 degrees and greater than or equal to 241 degrees; if so, enable the left indicator lamp 48, disable the right, front, and rear indicator lamps in process block 146; if not, enable the front and left indicator lamps, disable the rear and right indicator lamps in process block 148. The program returns to check if the emergency vehicle is still close to the motor vehicle.

The following set of constants for describing a particular situation are given by way of example and not by way of limitation:

| Motor Vehicle | Emergency Vehicle |
|---|---|
| Latitude = 30<br>Longitude = 70<br>Heading = 135° | Latitude = 34<br>Longitude = 86 |

Lat_new=34−30=4 Long_new=86−70=16

Angle of the emergency vehicle: $\theta=TAN^{-1}$ abs(16/4)= 75.96°

Since Lat_new is positive and Long_new is positive:

$\beta=360°-75.96°=284.04°$ Heading=135°

$\beta>$Heading; Therefore: $\alpha=284.04°-135°=149.04°$

According to the flow chart: $\alpha=149.04°$ lies between 121° and 150°

Therefore: right and rear indicator lamps will be enabled.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. An emergency vehicle alert system comprising:

an emergency vehicle unit receiving at least three GPS signals from a plurality of GPS satellites and converting thereof to an emergency location signal string, said emergency location signal string being transmitted by said emergency vehicle unit, said emergency location signal string providing a location of an emergency vehicle; and a motor vehicle unit receiving said emergency location signal string, said motor vehicle unit receiving at least three different GPS signals from the plurality of GPS satellites and converting thereof to a vehicle location signal string, said vehicle location signal string providing a location of a motor vehicle;

a warning display having at least four indicator lamps, said at least four indicator lamps corresponding to front, rear, left and right locations, said microcontroller enabling at least one said indicator lamp in response to the location of an emergency vehicle relative to said motor vehicle unit when the emergency vehicle is less than a set distance from said motor vehicle unit; and all indicator lights being enabled when the emergency vehicle is less than a second set distance from said motor vehicle unit, said second set distance being less than said set distance.

2. The emergency vehicle alert system of claim 1, further comprising:

said emergency vehicle unit having an emergency GPS antenna, an emergency GPS receiver, and an emergency RF antenna, said emergency GPS antenna receiving said at least three GPS signals from said plurality of GPS satellites, said emergency GPS receiver converting said at least three GPS signals into an emergency location signal string, said emergency location signal string being transmitted by said emergency RF antenna.

3. The emergency vehicle alert system of claim 2, further comprising:

said motor vehicle unit having a vehicle GPS antenna, vehicle GPS receiver, vehicle RF antenna, and a RF receiver, said vehicle GPS antenna receiving said at least three different GPS signals from said plurality of GPS satellites, said vehicle GPS receiver converting said at least three different GPS signals to a vehicle location signal string, said emergency location signal string being received by said vehicle RF antenna and input into said RF receiver.

4. The emergency vehicle alert system of claim 3, further comprising:

a microcontroller utilizing said emergency and vehicle location signal strings, said microcontroller enabling said at least one indicator lamp in response to said location signal strings.

5. An emergency vehicle alert system comprising:

an emergency vehicle unit includes an emergency GPS antenna, an emergency GPS receiver, and an emergency RF antenna, said emergency GPS antenna receiving at least three signals from a plurality of GPS satellites, said emergency GPS receiver converting said at least three GPS signals into an emergency location signal string, said emergency location signal string being transmitted by said emergency RF antenna, said emergency location signal string providing the location of an emergency vehicle; and a motor vehicle unit including a vehicle GPS antenna, vehicle GPS receiver, vehicle RF antenna, and a RF receiver, said vehicle GPS antenna receiving at least three different GPS signals from said plurality of GPS satellites, said vehicle GPS receiver converting said at least three different GPS signals to a vehicle location signal string, said vehicle location signal string providing a location of a motor vehicle, said emergency location signal string being received by said vehicle RF antenna and input by said RF receiver;

a warning display having at least four indicator lamps, said at least four indicator lamps corresponding to front, rear, left and right locations, said microcontroller enabling at least one said indicator lamp in response to the location of an emergency vehicle relative to said motor vehicle unit when the emergency vehicle is a less than a set distance from said motor vehicle unit; and all indicator lights being enabled when the emergency vehicle is less than a second set distance from said motor vehicle unit, said second set distance being less than said set distance.

6. The emergency vehicle alert system of claim 5, further comprising:

a microcontroller utilizing said emergency and vehicle location signal strings, said microcontroller enabling said at least one indicator lamp in response to the presence of the emergency vehicle.

7. A method of warning a motorist that an emergency vehicle is in close proximity, comprising the steps of:

(a) receiving at least three GPS signals from a plurality of GPS satellites;

(b) converting said at least three GPS signals into an emergency location signal string;

(c) transmitting said emergency location signal string;

(d) receiving said emergency location signal string;

(e) receiving at least three different GPS signals from the plurality of GPS satellites;

(f) converting said at least three different GPS signals into a motor vehicle location signal string (g) utilizing said emergency and motor vehicle location signal strings to determine the position of the emergency vehicle relative to the motor vehicle;

(h) enabling at least one indicator lamp which illustrates the position of the emergency vehicle relative to the motor vehicle when the emergency vehicle is less than a set distance from said motor vehicle unit; and (i) enabling all indicator lights when the emergency vehicle is less than a second set distance from said motor vehicle unit, said second set distance being less than said set distance.

8. The method of warning a motorist that an emergency vehicle is in close proximity of claim 7, further comprising the steps of:

enabling a no emergency vehicle indicator lamp when no emergency vehicle is close to the motor vehicle.

* * * * *